US010364127B2

(12) United States Patent
Müller et al.

(10) Patent No.: US 10,364,127 B2
(45) Date of Patent: Jul. 30, 2019

(54) ELEVATOR INSTALLATION SAFETY SYSTEM AND METHOD OF CHECKING SAME

(71) Applicant: Inventio AG, Hergiswil (CH)

(72) Inventors: Rudolf J. Müller, Lucerne (CH); Eric Birrer, Buchrain (CH)

(73) Assignee: INVENTIO AG, Hergiswil (CH)

( * ) Notice: Subject to any disclaimer, the term of this patent is extended or adjusted under 35 U.S.C. 154(b) by 569 days.

(21) Appl. No.: 15/105,642

(22) PCT Filed: Nov. 18, 2014

(86) PCT No.: PCT/EP2014/074935
§ 371 (c)(1),
(2) Date: Jun. 17, 2016

(87) PCT Pub. No.: WO2015/090809
PCT Pub. Date: Jun. 25, 2015

(65) Prior Publication Data

US 2016/0311653 A1 Oct. 27, 2016

(30) Foreign Application Priority Data

Dec. 18, 2013 (EP) ..... 13198207

(51) Int. Cl.
*B66B 1/34* (2006.01)
*B66B 5/00* (2006.01)
*B66B 13/22* (2006.01)

(52) U.S. Cl.
CPC ..... *B66B 5/0093* (2013.01); *B66B 13/22* (2013.01)

(58) Field of Classification Search
CPC ..... B66B 13/22; B66B 5/0093
USPC ..... 187/247, 316, 391, 393, 395
See application file for complete search history.

(56) References Cited

U.S. PATENT DOCUMENTS 5,487,448 A 1/1996 Schollkopf et al.
5,977,662 A 11/1999 Lamarche et al.
7,401,685 B2 * 7/2008 Roschier ..... B66B 13/22 187/277
7,575,102 B2 * 8/2009 Matsuoka ..... B66B 5/0093 187/391
7,617,911 B2 * 11/2009 Mattila ..... B66B 5/0031 187/288

(Continued)

FOREIGN PATENT DOCUMENTS

CN 201258211 6/2009
WO 2011054674 A1 5/2011

*Primary Examiner* — Anthony J Salata
(74) *Attorney, Agent, or Firm* — William J. Clemens; Shumaker, Loop & Kendrick, LLP

(57) ABSTRACT

A safety circuit for an elevator system includes a plurality of switch contacts, at least one first switch contact, and a control unit. The at least one first switch contact can be switched electronically and can be bridged using a conductive bridging element, in particular for maintenance or testing purposes. Additionally, the control unit is directly or indirectly connected to the safety circuit. The at least one first switch contact can be switched on the basis of instructions of the control unit in order to change the state of the safety circuit. In the process, the at least one control unit detects the absence of the state change of the safety circuit, in particular when the at least one first switch contact is being bridged by the bridging element.

18 Claims, 2 Drawing Sheets

(56) References Cited

U.S. PATENT DOCUMENTS

| | | | | |
|---|---|---|---|---|
| 7,980,363 | B2 * | 7/2011 | Kattainen | B66B 5/0056 187/247 |
| 8,136,637 | B2 * | 3/2012 | Coquerelle | B66B 5/0068 187/302 |
| 8,413,765 | B2 * | 4/2013 | Stratmann | B66B 5/0031 187/247 |
| 8,443,944 | B2 * | 5/2013 | Sonnenmoser | B66B 13/22 187/247 |
| 8,552,738 | B2 * | 10/2013 | Quinn | B66B 13/22 187/391 |
| 8,941,964 | B2 * | 1/2015 | Madar | H02H 3/08 361/93.1 |
| 9,061,863 | B2 * | 6/2015 | Birrer | B66B 13/22 |
| 2011/0036668 | A1 | 2/2011 | Stratmann | |
| 2016/0221793 | A1 * | 8/2016 | De Coi | B66B 5/0031 |
| 2017/0001833 | A1 * | 1/2017 | Lustenberger | B66B 13/22 |

* cited by examiner

ELEVATOR INSTALLATION SAFETY SYSTEM AND METHOD OF CHECKING SAME

FIELD

The invention relates to a safety system and an elevator installation with this safety system and to a method of operating the elevator installation with this safety system.

BACKGROUND

Current elevator installations are equipped with a safety system comprising a safety circuit. This consists of a plurality of switch contacts, which are connected in series, of different safety elements for shaft, door and cable monitoring. Opening one of these switch contacts has the consequence that the entire safety circuit is interrupted. This in turn causes interruption of power supply for the main drive and thus adoption of a rest state. For maintenance purposes or test purposes of the elevator installation individual ones or several of these switch contacts have to be bridged over by means of bridging-over elements. In the case of travel to a buffer it is necessary, for example, for a limit switch to be bridged over so as to be able to travel beyond the travel range, which is permissible in normal operation, in the shaft onto the buffer. Before the elevator installation can resume its normal operation all bridging-over elements would have to be removed from the safety circuit. However, it cannot be excluded that a maintenance engineer forgets to remove a bridging-over element again. Accordingly, reliability of the safety circuit is impaired, since a bridged-over switch contact in a given case may be unable to interrupt the safety circuit.

SUMMARY

It is therefore the object of the invention to create a safety system with a safety circuit for an elevator installation which releases normal operation of an elevator installation only if a previously inserted bridging-over element has been removed.

A safety system for an elevator installation preferably comprises a safety circuit with a plurality of switch contacts and a control unit. At least one first switch contact is electronically switchable and can be bridged over with use of a conductive bridging-over element, particularly for maintenance purposes or test purposes. In addition, the control unit is indirectly or directly connected with the safety circuit. The first switch contact is switchable on the basis of an instruction of the control unit so as to achieve a change in state of the safety circuit. In that case, the control unit is arranged to detect absence of the change in state of the safety circuit if the at least one switch contact is bridged over by the bridging-over element.

By "bridging-over element" there is to be understood here a conductive element for temporary bridging-over of a switch contact.

It is of advantage that a previously bridged-over first switch contact can, for example, be opened in a test and, when the bridging-over element of the safety circuit is removed, interruption of the safety circuit can be detected as expected. Such a change in state arises only when the bridging-over element has been removed. Accordingly, removal of a bridging-over element is reliably recognizable by means of this test and the elevator installation can be released for operation. This test can optionally also be carried out during normal operation so as to detect an incorrectly inserted bridging-over element. In that case, the test can be carried, for example, once per day.

By electronically switchable switch contact there is to be understood here a switch contact which is switchable by an electronic computer unit such as, for example, the aforesaid control unit. For that purpose a signal is communicated by the computer unit to the switch contact. The switch contact itself can be designed as an electronic component in the form of an analog switch or a semiconductor switch such as, for example, field effect transistors, bipolar transistors, switching diodes, thyristors or the like. Alternatively thereto a switch contact can also be electromechanically designed, such as, for example, a relay, circuitbreaker or the like.

By "control unit" there is to be understood a unit with at least one processor, which can issue at least switching commands to an electronically switchable switch contact. In addition, the control unit typically comprises a data memory unit and a work memory unit. In a preferred embodiment the control unit is designed as a main control of the elevator installation. Alternatively thereto the control unit can also be designed as a separate safety control unit.

Operation of the elevator installation can preferably be interrupted by the control unit if on the basis of the instruction of the control unit to switch the first switch contact no change in state of the safety circuit is detectable.

In that regard it is advantageous that if a bridging-over element is present, operation is not released. Safe starting of operation of the elevator installation is thus ensured. The elevator installation can enter into operation only if the bridging-over element has been removed and switching of the first switch contact has an influence on the state of the safety circuit or opening of the first switch can cause interruption of the safety circuit.

The safety circuit preferably comprises at least one second electronically switchable switch contact, wherein the second switch contact is switchable by the control unit when on the basis of the instruction of the control unit to switch the first switch contact no change in state of the safety circuit is detectable.

The safety circuit is thereby interruptible in simple mode and manner by the switching or opening of the second switch contact. Accordingly, power supply of a drive and/or main control of the elevator installation is interrupted and the elevator installation is brought to a rest state.

Alternatively or in addition thereto the control unit itself can bring itself into a safety mode in which the control unit can no longer execute travel commands and/or accept car calls.

A fault signal can preferably be stored at a data memory unit, preferably a data memory unit of the control unit, when on the basis of the instruction of the control unit to switch the switch contact no change in state of the safety circuit is detectable.

By "fault signal" there is to be understood a signal reflecting a negative test result. The control unit in the case of a switching process of the first switch contact expects a change in state in the safety circuit. If no change in state in the safety circuit can be ascertained, the control unit assesses the test as negative and in correspondence with this result stores a fault signal at a data memory unit. The fault signal can preferably also include characteristic information with respect to the first switch contact which was switched. Such characteristic information bears, for example, a value uniquely assignable to the first switch contact. The first switch contact is thus uniquely identifiable.

This has the advantage that a maintenance engineer when reading out the data memory unit is referred simply and quickly to the cause of the shutdown of the elevator installation and does not waste time on fault investigation. The characteristic information with respect to the first switch contact which was switched, by which information the bridged-over first switch contact can be localized particularly quickly, is of particular advantage.

The first switch contact after the instruction by the control unit to switch is preferably switched back after a predetermined period of time, in which case the period of time is at least 1 millisecond, preferably lasts not longer than 30 seconds and with particular preference is between 500 milliseconds and 10 seconds.

In that case, the time period has to last long enough for a voltage drop or power interruption in the safety circuit to be reliably detectable and primarily depends on the response time of the first switch contact. In the case of a semiconductor switch this time period can even be less than 1 millisecond. Similarly, the time period for switching back should not last too long so as to not unnecessarily delay operation of the elevator installation.

In the case of a positive test result after switching back the first switch contact, the operation of the elevator installation can be started. Conversely, in the case of a negative test result the test is to be repeated after switching back the first switch contact.

The switching back is preferably undertaken autonomously by the first switch contact. For that purpose the first switch contact has a resetting unit. This resetting unit is designed as a time relay, monoflop or the like, which triggers switching back of the first switch contact.

The safety system preferably comprises a further control unit connected with the safety circuit. This further control unit is associated with, in particular, a shaft information system. In that case the further control unit is designed in such a way that this switches the first switch contact on the basis of an instruction of the control unit.

If the further control unit is present, this can trigger switching-back of the first switch contact. In this embodiment resetting can take place not only on the basis of elapsing of the predetermined period of time, but in addition also on the basis of a check for predetermined conditions.

An excess speed switch contact or a limit switch contact, which interrupts the safety circuit in the case of excess speed or travel beyond a permissible end position in the shaft, is preferably assigned to the further control unit. Obviously, the excess speed switch contact and the limit switch contact can preferably be designed as first switch contacts.

In the case of an excess speed switch contact a condition for switching back is, for example, fulfilled if the further control ascertains that at the instant of switching back no excess speed of the car is ascertainable. Correspondingly, a limit switch contact can be switched back when the car stops in a permissible position between the two end positions. The further control unit can obtain the two items of information, i.e. car speed and car position, by way of the shaft information system. On the basis of these items of information the further control unit decides whether a condition for switching back the at least one first switch contact is fulfilled and switches back the respective first switch contact if the condition is fulfilled.

In a preferred embodiment an individual further control unit can be associated with the first electronically switchable switch element.

A further aspect of the invention relates to an elevator installation with the above-described safety circuit.

In addition, the invention also relates to a method for checking the safety system of an elevator installation, comprising the steps of:

switching at least one first electronically switchable switch contact of a safety circuit with use of a control unit for achieving a change in state of the safety circuit; and detecting absence of a change in state of the safety circuit by the control unit when the first switch contact is bridged over by a bridging-over element.

A further step preferably relates to interruption of operation of the elevator installation by the control unit in the case of detection of absence of the change in state of the safety circuit. Accordingly, a bridging-over element may still be inserted and the first switch contact bridged over.

A further step preferably relates to switching a second electronically switchable switch contact with use of a command of the control unit for interrupting operation of the elevator installation in the case of detection of absence of the change in state of the safety circuit.

A further step preferably relates to storage of a fault signal at a data memory unit, preferably a data memory unit of the control unit, in the case of detection of absence of the change in state of the safety circuit.

For preference, yet a further step relates to switching back, particularly autonomous switching back, of the first switched switch element after a predetermined period of time, wherein the period of time is at least one 1 millisecond, preferably does not last longer than 30 seconds and, with particular preference, is between 500 milliseconds and 10 seconds.

Finally, a last step preferably relates to switching the first switch contact with use of an instruction of a second control unit, which is associated with, in particular, a shaft information system. In that case, switching-back of the first switch contact is possible as an option with use of an instruction of the further control unit after checking a predetermined condition.

DESCRIPTION OF THE DRAWINGS

The invention is better described in the following by way of embodiments, in which.

DETAILED DESCRIPTION

Figure 1:
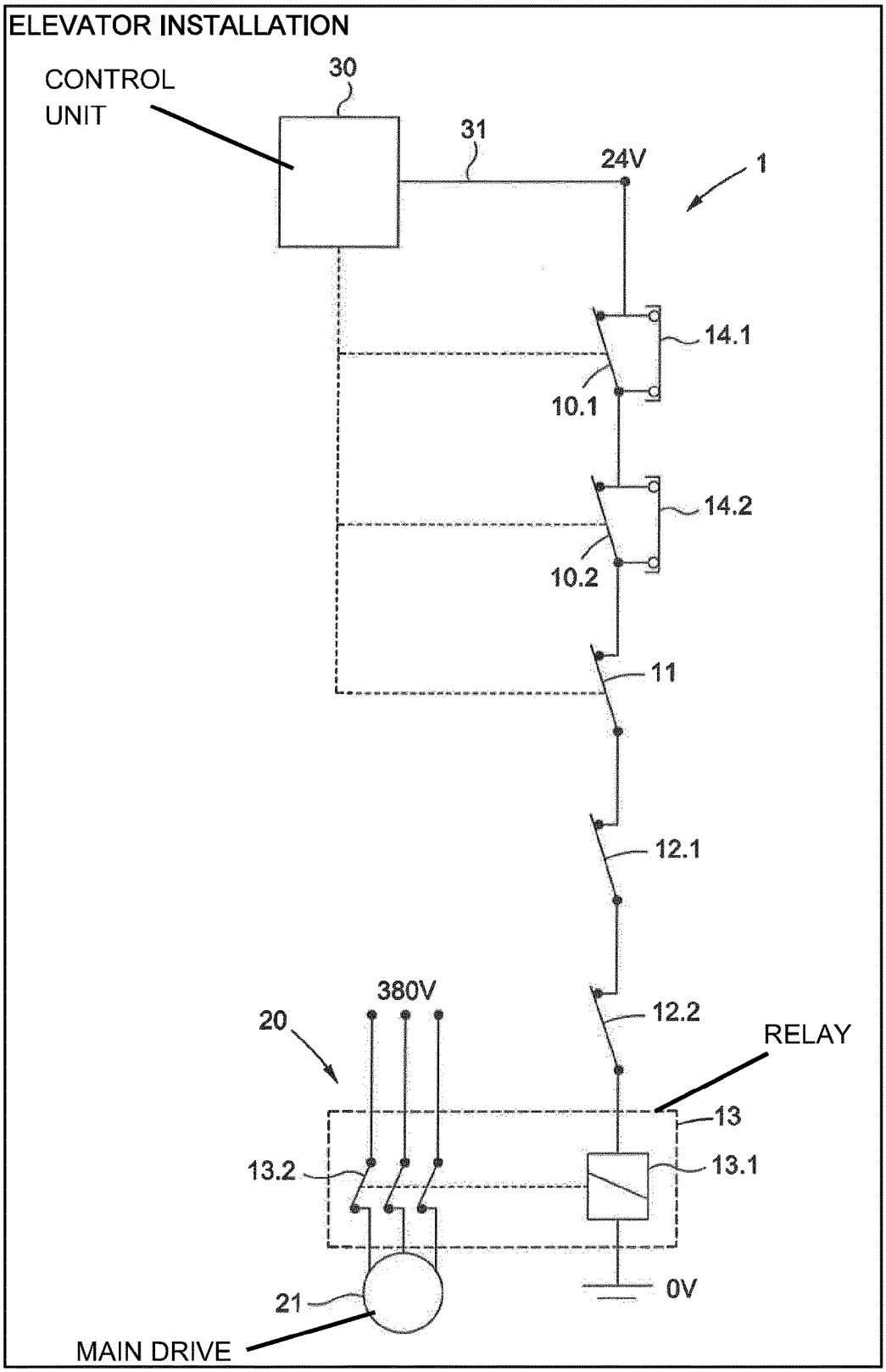
FIG. 1 schematically shows a circuit diagram of the safety system according to the invention, comprising a safety circuit of a first embodiment with a control unit.

FIG. 1 shows a safety system comprising a safety circuit 1 with a plurality of switch contacts 10.1, 10.2, 11, 12.1, 12.2 connected in series. The switch contacts 10.1, 10.2, 12.1, 12.2 monitor a state of a safety-relevant component of the elevator such as, for example, a shaft door, a car door, a speed limiting system, an emergency stop switch or a shaft limit switch. In the illustrated example the safety circuit 1 comprises five switch contacts 10.1, 10.2, 11, 12.1, 12.2. The number of switch contacts in the safety circuit 1 is obviously variable and depends on the number of safety-relevant components to be monitored. The safety circuit 1 is in a safe state when all switch contacts 10.1, 10.2, 11, 12.1, 12.2 are closed.

The safety circuit 1 is supplied with power from, for example, a 24V source. In a safe state of the safety circuit 1 a corresponding current flows across the switch contacts 10.1, 10.2, 11, 12.1, 12.2. A relay 13 is connected at one end of the safety circuit 1 with the same and with a 0V conductor. The relay 13 comprises a switching magnet 13.1 and a switch 13.2, the latter being integrated in a power supply 20 of a main drive 21. The switching magnet 13.1 switches the associated switch 13.2 in correspondence with a switch state of the safety circuit 1. In that case the energized switching magnet 13.1 keeps the switch 13.2 closed. As soon as a switch contact 10.1, 10.2, 11, 12.1, 12.2 of the safety circuit 1 is open and the current flow in the safety circuit 1 is interrupted, the power feed to the switching magnet 13.1 is also interrupted. As a consequence, the associated switch 13.2 is opened and the power supply 20 to the main drive 21 interrupted.

In the depicted illustration, two bridging-over elements 14.1, 14.2 which bridge over the two switch contacts 10.1, 10.2 are inserted. This is carried out, for example, for testing purposes or maintenance purposes of the elevator installation so as to permit certain travel states which otherwise are not permitted in a normal operating mode. After the conclusion of such tests or maintenance operations the bridging-over elements are removed again so as to guarantee safe operation of the elevator installation in a normal mode. Before the elevator installation is again operable in the normal mode it is checked whether the bridging-over elements 14.1, 14.2 have actually been removed.

Figure 2:
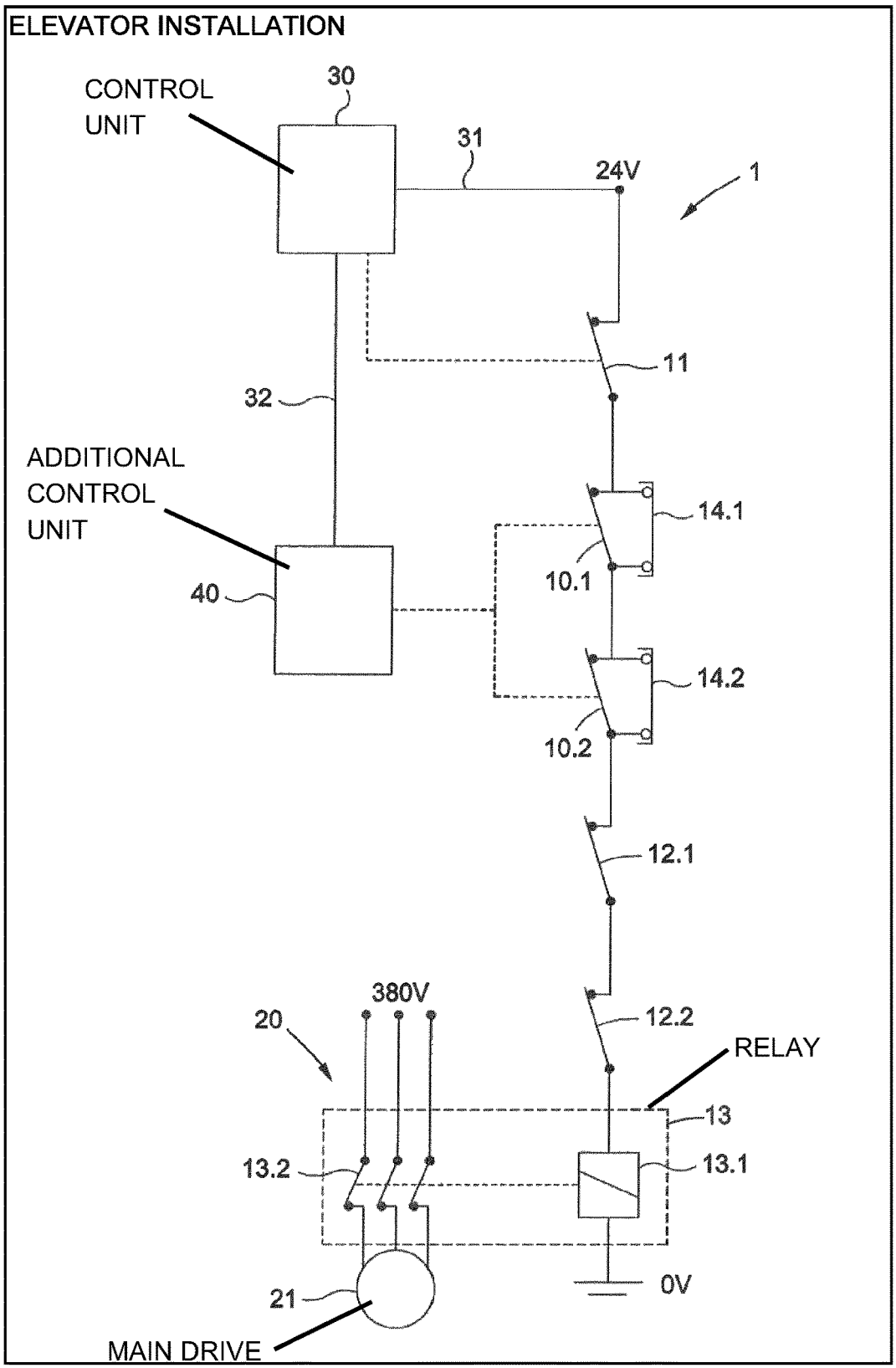
FIG. 2 schematically shows a circuit diagram of the safety system according to the invention, comprising a safety circuit of a second embodiment with a further control unit.

For that purpose the safety circuit 1 is connected with a control unit 30, preferably the main control unit of the elevator installation. The control unit 30 can on the one hand recognize the state of the safety circuit 1 by way of the line 31 and on the other hand transmit control signals for switching the switch contacts 10.1, 10.2, 11. This action of the control unit 30 on the switch contacts 10.1, 10.2, 11 is illustrated in FIGS. 1 and 2 by dashed lines.

In a test the two switch contacts 10.1, 10.2 are switched by the control unit 30 into an open state. If the two bridging-over elements 14.1, 14.2 have been removed, this opening causes interruption of the safety circuit 1. This interruption can be recognized by the control unit 30. Accordingly, the expectation of the control unit 30 has been fulfilled and the elevator installation can be safely operated in the normal mode. The switch contacts 10.1, 10.2 are preferably opened in a predetermined sequence so as to individually test each switch contact 10.1, 10.2.

Conversely, the expectation of the control unit is not fulfilled if opening of the switch contacts 10.1, 10.2 does not lead to interruption of the safety circuit 1. In such a case it has to be assumed that removal of one or both of the bridging-over elements 14.1, 14.2 has not taken place. Accordingly, opening of the switch contacts 10.1, 10.2 has no effect on the state of the safety circuit 1. For reasons of safety this is not acceptable in the normal mode. Accordingly, the control unit 30 opens the safety contact 11 so as to prevent further operation of the elevator installation.

In the case of a negative test result a fault signal can be stored in a data memory unit of the control unit 30. Advantageously, the fault signal contains characteristic information, particularly a unique address about which switch contact or contacts 10.1, 10.2 is or are bridged over. This makes it possible for a maintenance engineer to quickly localize and remove an overlooked bridging-over element 14.1, 14.2.

After a predetermined period of time the two switch contacts 10.1, 10.2 are switched back or closed. In that case the time period is at least 1 millisecond and preferably at most 30 seconds. A particularly preferred duration of this time period is 500 milliseconds to 10 seconds. The switch contacts 10.1, 10.2 comprise a resetting unit for the resetting.

Such a resetting unit is preferably designed as a time relay or monoflop. In that case, the resetting unit is settable to a specific time period. After expiry of this time period the resetting unit triggers resetting of the associated switch contact 10.1, 10.2.

The safety circuit 1 can obviously also have additional switch contacts 12.1, 12.2 which are not switchable by means of a control unit 30. Such non-switchable switch contacts 12.1, 12.2 preferably do not have to be bridged over for maintenance operations. These switch contacts 12.1, 12.2 monitor, for example, the state of shaft doors or car doors as well as an emergency switch. The safety circuit 1 is accordingly designed in such a way that within the scope of maintenance preferably only electronically switchable switch contacts 10.1, 10.2 have to be bridged over by means of a bridging-over element 14.1, 14.2.

FIG. 2 shows an alternative embodiment of the safety system with an additional control unit 40. By contrast to the first embodiment according to FIG. 1 the two switch contacts 10.1, 10.2 are activated by the control unit 40. The control unit 40 is connected with the control unit 30 by way of a line 32. The control unit 40 obtains control signals from the control unit 30 by way of this line 32.

In this alternative embodiment the test of the switch contacts 10.1, 10.2 is similarly triggered by the control unit 30 in that the control unit 30 transmits to the control unit 40 by way of the line 32 a control signal for opening the switch contacts 10.1, 10.2. The control unit 40 correspondingly opens the switch contacts 10.1, 10.2 so as to check whether the two bridging-over elements 14.1, 14.2 have been removed.

If a further control unit 40 is present, resetting of the associated switch 10.1, 10.2 can be triggered by the control unit 40. It is therefore possible to dispense with the resetting units of the first embodiment in the design of the safety system. Resetting of the switch contacts 10.1, 10.2 can be triggered not just on the basis of elapsing of a period of time, but alternatively or optionally also on the basis of checking a condition. The test otherwise takes place analogously to the first embodiment.

The control unit 40 is, for example, associated with a shaft information system. The shaft information system has data with respect to the speed and position of an elevator car available. Accordingly, the switch contact 10.1 is switchable on the basis of excess speed of the elevator car and the switch contact 10.2 is designed as a limit switch. The switch contact 10.1 is to be bridged over in the case of a safety braking test and the switch contact 10.2 in the case of test travel onto a buffer. Accordingly, a condition for resetting the switch contact 10.1 is linked to maintenance of a permissible car speed and resetting of the switch contact 10.2 is linked to maintenance of a permissible car position between two end positions in the shaft.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety system for an elevator installation comprising:

a safety circuit including a plurality of switch contacts, wherein a first one of the switch contacts is electronically switchable and can be bridged over with an associated conductive bridging-over element for maintenance purposes or test purposes, a control unit connected with the safety circuit wherein the first switch contact is switched in response to a control signal transmitted by the control unit to change a state of the safety circuit and the control unit detects an absence of the change in state of the safety circuit if the first switch contact is bridged over by the bridging-over element; and a second one of the switch contacts that is electronically switchable and is switched in response to another control signal transmitted by the control unit when the control signal to the first contact is transmitted and no change in state of the safety circuit is detected.

2. The safety system according to claim 1 wherein operation of the elevator installation is interrupted by the control unit when the control signal is transmitted by the control unit to switch the first switch contact and no change in state of the safety circuit is detected by the control unit.

3. The safety system according to claim 1 wherein the control unit stores a fault signal when the control signal is transmitted by the control unit to switch the first switch contact and no change in state of the safety circuit is detected.

4. The safety system according to claim 3 wherein the fault signal includes characteristic information with respect to the first switch contact, wherein the first switch contact is uniquely identifiable based on the characteristic information.

5. The safety system according to claim 1 wherein the first switch contact, after switching in response to the control signal transmitted by the control unit, switches back after a predetermined period of time.

6. The safety system according to claim 5 wherein the predetermined period of time is at least one millisecond.

7. The safety system according to claim 5 wherein the predetermined period of time lasts not longer than 30 seconds.

8. The safety system according to claim 5 wherein the predetermined period of time is between 500 milliseconds and 10 seconds.

9. The safety system according to claim 1 including another control unit, which is associated with a shaft information system of the elevator installation, connected to the safety circuit, wherein the further control unit switches the first switch contact in response to the control signal transmitted by the control unit.

10. The safety system according to claim 1 wherein the switch contacts are connected in series to a relay in a power supply of a main drive of the elevator installation.

11. A method of checking a safety system of an elevator installation, comprising the steps of:

switching a first electronically switchable switch contact of a safety circuit in the safety system in response to a control signal transmitted by a control unit for changing a state of the safety circuit;

detecting by the control unit an absence of the change in state of the safety circuit if the first switch contact is bridged over by a bridging-over element and switching a second electronically switchable switch contact of the safety circuit in response to another control signal transmitted by the control unit to interrupt operation of the elevator installation when the absence of the change in state of the safety circuit is detected.

12. The method according to claim 11 further comprising a step of interrupting operation of the elevator installation by the control unit when the absence of the change in state of the safety circuit is detected.

13. The method according to claim 11 further comprising a step of storing a fault signal in the control unit when the absence of the change in state in the safety circuit is detected.

14. The method according to claim 11 further comprising a step of switching back the first switched switch contact after a predetermined period of time.

15. The method according to claim 14 wherein the predetermined period of time is at least one millisecond.

16. The method according to claim 14 wherein the predetermined period of time lasts not longer than 30 seconds.

17. The method according to claim 14 wherein the predetermined period of time is between 500 milliseconds and 10 seconds.

18. The method according to claim 11 further comprising a step of switching the first switch contact in response to another control signal transmitted by a further control unit associated with a shaft information system of the elevator installation.

* * * * *